US007375710B2

(12) United States Patent
Tobita

(10) Patent No.: US 7,375,710 B2
(45) Date of Patent: May 20, 2008

(54) IMAGE DISPLAY APPARATUS HAVING GRADATION POTENTIAL GENERATING CIRCUIT

(75) Inventor: Youichi Tobita, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 729 days.

(21) Appl. No.: 10/851,169

(22) Filed: May 24, 2004

(65) Prior Publication Data

US 2005/0012762 A1 Jan. 20, 2005

(30) Foreign Application Priority Data

Jul. 16, 2003 (JP) ..... 2003-275529

(51) Int. Cl.
*G09G 3/36* (2006.01)

(52) U.S. Cl. ..... 345/89; 345/100

(58) Field of Classification Search ..... 345/89, 345/100

See application file for complete search history.

(56) References Cited

U.S. PATENT DOCUMENTS 6,326,913 B1 * 12/2001 Chao et al. ..... 341/144
7,034,797 B2 * 4/2006 Maki ..... 345/100

FOREIGN PATENT DOCUMENTS

JP 54-004527 1/1979
JP 63-188196 8/1988
JP 5-40451 2/1993
JP 05-281921 10/1993
JP 07-028031 1/1995
JP 07-072829 3/1995
JP 2001-34234 2/2001
JP 2002-032053 1/2002
JP 2003-233356 8/2003
JP 2003-233357 8/2003

* cited by examiner

*Primary Examiner*—Richard Hjerpe
*Assistant Examiner*—Leonid Shapiro
(74) *Attorney, Agent, or Firm*—Oblon, Spivak, McClelland, Maier & Neustadt, P.C.

(57) ABSTRACT

A gradation potential generating circuit of a color liquid crystal display apparatus includes a first ladder resistor circuit having a relatively high resistance value and generating first to sixty-fourth gradation potentials by dividing a power supply voltage to apply them to first to sixty-fourth nodes, and a second ladder resistor circuit having a relatively low resistance value, activated during an initial predetermined period of a time period while a selected gradation potential is applied to a data line, and generating first to sixty-fourth gradation potentials by dividing the power supply voltage to apply them to first to sixty-fourth nodes, and 65 switches. Therefore, since the ladder resistor circuit having low resistance is activated in a pulsed manner, the data line can be charged/discharged at a high-speed with low current consumption.

14 Claims, 7 Drawing Sheets

IMAGE DISPLAY APPARATUS HAVING GRADATION POTENTIAL GENERATING CIRCUIT

BACKGROUND OF THE INVENTION

1. Field of the Invention

The present invention relates to an image display apparatus, and more particularly to an image display apparatus having a gradation potential generating circuit.

2. Description of the Background Art

Conventionally, in a liquid crystal display apparatus, a plurality of gradation potentials are generated by a gradation potential generating circuit, one of the plurality of gradation potentials is selected in response to an image data signal, and the selected gradation potential is applied to a liquid crystal cell via a data line. The gradation potential generating circuit includes a ladder resistor circuit having a plurality of resistors connected in series between a line of a high potential and a line of a low potential (for example, see Japanese Patent Laying-Open No. 2001-034234).

To achieve high-speed charge/discharge of a data line having a large capacitance in such a liquid crystal display apparatus, the ladder resistor circuit should have a small resistance value to increase the current flowing through the ladder resistor circuit. However, an increase in the current flowing through the ladder resistor circuit causes an increase in the current consumption of the liquid crystal display apparatus.

SUMMARY OF THE INVENTION

One main object of the present invention is therefore to provide an image display apparatus having low current consumption and capable of achieving high-speed charge/discharge of a data line.

An image display apparatus in accordance with the present invention includes a pixel array including a plurality of pixel display circuits arranged in a plurality of rows and a plurality of columns and each displaying a pixel in response to a gradation potential, a plurality of gate lines provided corresponding to the plurality of rows, respectively, and a plurality of data lines provided corresponding to the plurality of columns, respectively; a vertical scanning circuit sequentially selecting the plurality of gate lines for a prescribed time period and activating each pixel display circuit corresponding to the selected gate line; a gradation potential generating circuit outputting a plurality of gradation potentials different from each other; and a decode circuit provided corresponding to each data line and selecting one of the plurality of gradation potentials in response to an image data signal to apply the selected gradation potential to the activated pixel display circuit via a corresponding data line while one gate line is selected by the vertical scanning circuit. The gradation potential generating circuit includes a first ladder resistor circuit having a relatively high resistance value and generating the plurality of gradation potentials by dividing a power supply voltage to apply the generated plurality of gradation potentials to a plurality of first nodes, respectively; a second ladder resistor circuit having a relatively low resistance value, activated during an initial predetermined period of a time period during which the gradation potential selected by the decode circuit is applied to the corresponding data line, and generating the plurality of gradation potentials by dividing the power supply voltage; and a switching circuit applying the plurality of gradation potentials generated by the second ladder resistor circuit for the predetermined period to the plurality of first nodes, respectively.

Therefore, since the second ladder resistor circuit having a relatively low resistance value is activated only for the initial predetermined period of the time period during which the selected gradation potential is applied to the data line, the data line can be charged/discharged at a high speed with low current consumption.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
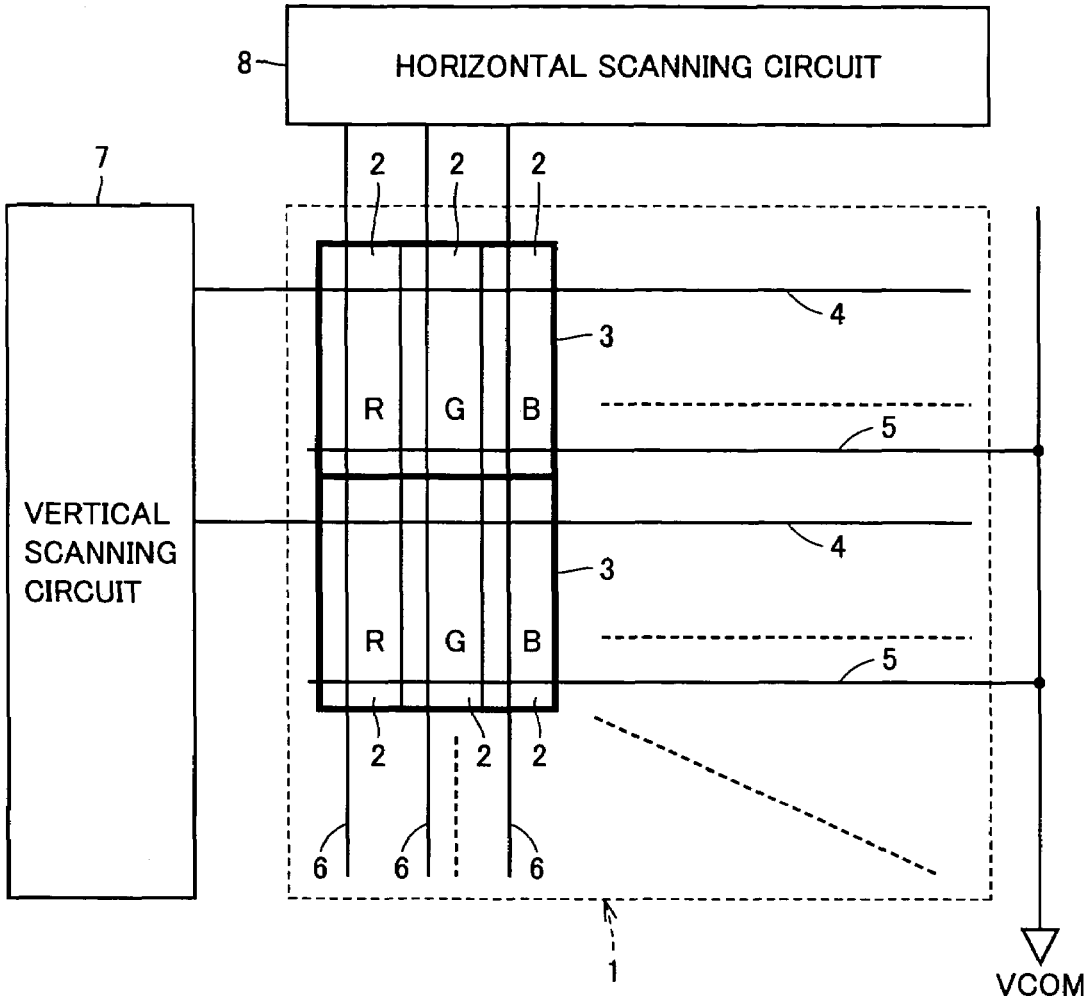
FIG. 1 is a block diagram showing a structure of a color liquid crystal display apparatus in accordance with an embodiment of the present invention.

FIG. 1 is a block diagram showing a structure of a color liquid crystal display apparatus in accordance with an embodiment of the present invention. In FIG. 1, the color liquid crystal display apparatus includes a liquid crystal panel 1, a vertical scanning circuit 7 and a horizontal scanning circuit 8, and is provided in a cellular phone, for example.

Liquid crystal panel 1 includes a plurality of liquid crystal cells 2 arranged in a plurality of rows and a plurality of columns, a gate line 4 and a common potential line 5 provided corresponding to each row, and a data line 6 provided corresponding to each column.

In each row, liquid crystal cells 2 are grouped by threes beforehand. Three liquid crystal cells 2 in each group are provided with R, G, and B color filters, respectively. Three liquid crystal cells 2 in each group form one pixel 3.

Figure 2:
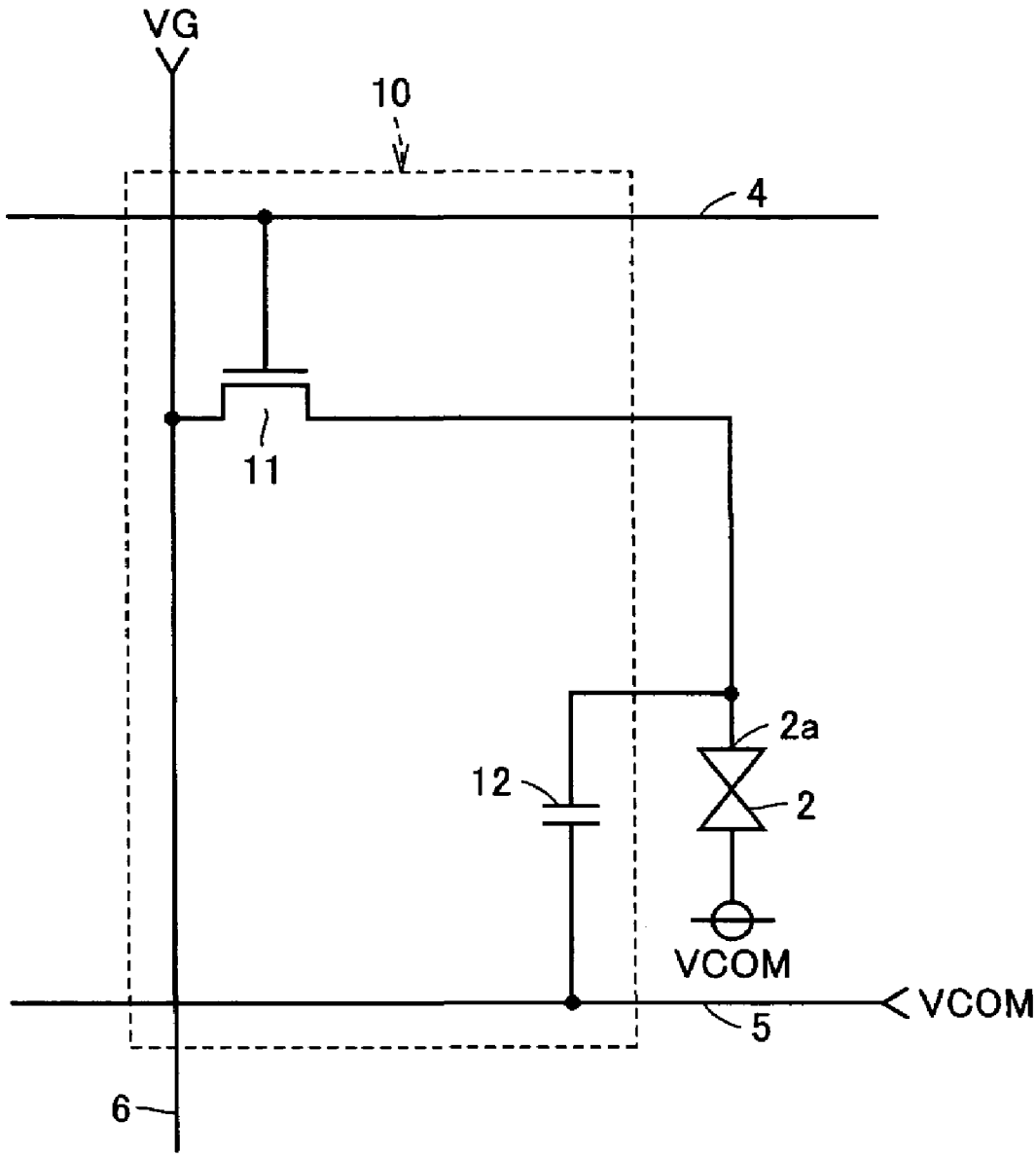
FIG. 2 is a circuit diagram showing a structure of a liquid crystal driving circuit provided corresponding to each liquid crystal cell shown in FIG. 1.

Each liquid crystal cell 2 is provided with a liquid crystal driving circuit 10, as shown in FIG. 2. Liquid crystal driving circuit 10 includes an N-type transistor 11 and a capacitor 12. N-type transistor 11 is connected between data line 6 and one electrode 2*a* of liquid crystal cell 2, and its gate is connected to gate line 4. Capacitor 12 is connected between one electrode 2*a* of liquid crystal cell 2 and common potential line 5. A common potential VCOM is applied to the other electrode of liquid crystal cell 2, as well as to common potential line 5.

Referring back to FIG. 1, vertical scanning circuit 7 sequentially selects a plurality of gate lines 4 for a prescribed time period in response to an image signal, and drives the selected gate line 4 to an "H" level of selection levels. When gate line 4 is at an "H" level, N-type transistor 11 in FIG. 2 becomes conductive, connecting one electrode 2*a* of each liquid crystal cell 2 corresponding to that gate line 4 and data line 6 corresponding to that liquid crystal cell 2.

Horizontal scanning circuit 8 applies a gradation potential VG to each data line 6 while one gate line 4 is selected by vertical scanning circuit 7 in response to the image signal. Light transmittance of liquid crystal cell 2 varies depending on the level of gradation potential VG. When all liquid crystal cells 2 of liquid crystal panel 1 are scanned by vertical scanning circuit 7 and horizontal scanning circuit 8, an image is displayed on liquid crystal panel 1.

Figure 3:
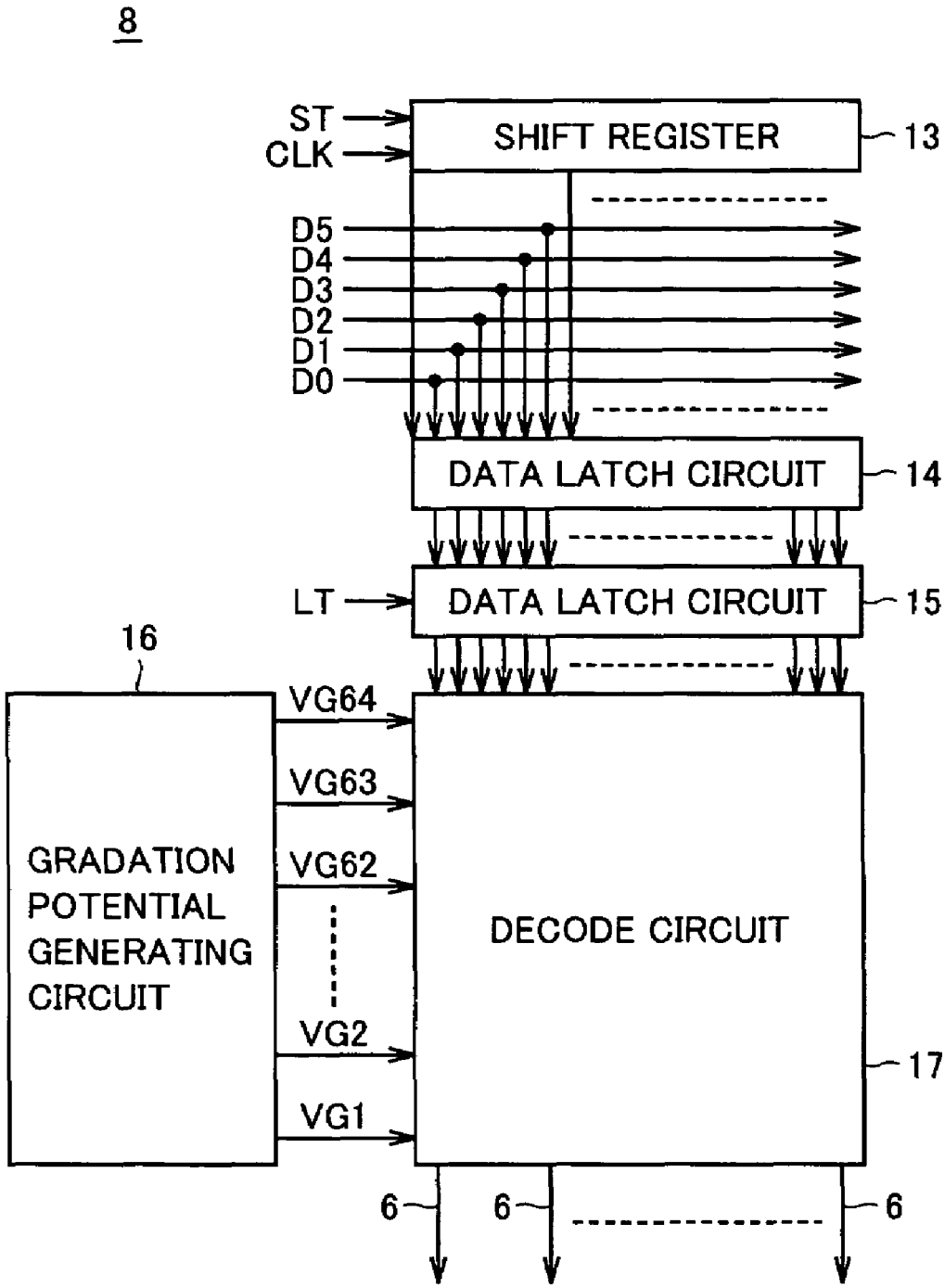
FIG. 3 is a block diagram showing a structure of a horizontal scanning circuit shown in FIG. 1.

FIG. 3 is a block diagram showing a structure of horizontal scanning circuit 8. In FIG. 3, horizontal scanning circuit 8 includes a shift register 13, data latch circuits 14 and 15, a gradation potential generating circuit 16, and a decode circuit 17. Shift register 13 controls data latch circuit 14 in synchronization with a start signal ST and a clock signal CLK. Data latch circuit 14, controlled by shift register 13, sequentially latches image data signals D0-D5 for each data line 6 to latch image data signals D0-D5 for one row. Data latch circuit 15 is controlled by a latch signal LT, and latches image data signals D0-D5 for one row latched by data latch circuit 14 all at once. Data latch circuit 15 applies the latched image data signals D0-D5 and their complementary signals /D0-/D5 to decode circuit 17, for each data line 6.

Gradation potential generating circuit 16 generates 64 gradation potentials VG1-VG64. Decode circuit 17 selects one of the 64 gradation potentials VG1-VG64 for each data line 6 in response to image data signals D0-D5 and their complementary signals /D0-/D5 applied from data latch circuit 15, and applies the selected gradation potential to that data line 6.

Figure 4:
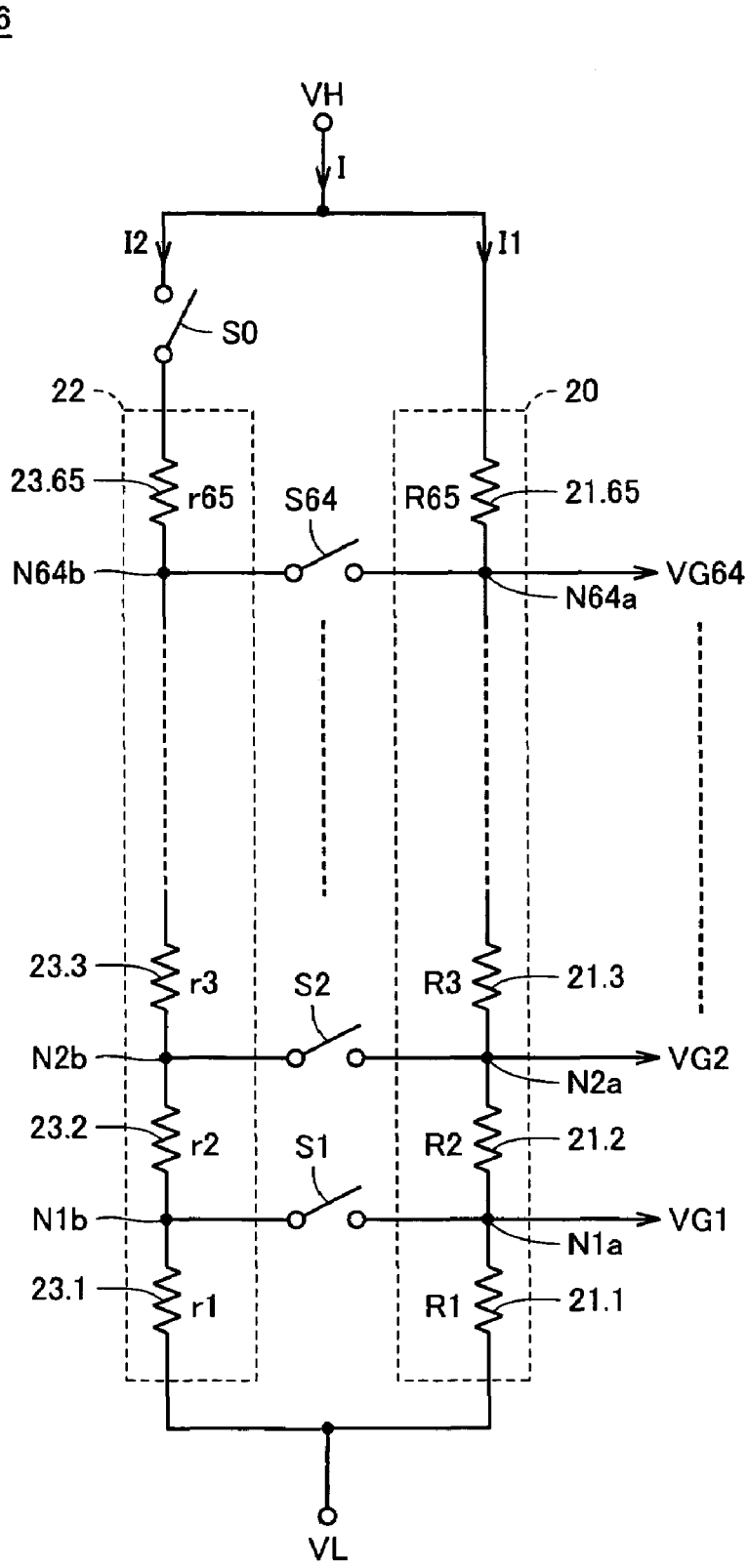
FIG. 4 is a circuit diagram showing a structure of a gradation potential generating circuit shown in FIG. 3.

FIG. 4 is a circuit diagram showing a structure of gradation potential generating circuit 16. In FIG. 4, gradation potential generating circuit 16 includes ladder resistor circuits 20 and 22, and switches S0-S64.

Ladder resistor circuit 20 includes 65 resistors 21.1-21.65 connected in series between a line of a low potential VL and a line of a high potential VH. Sixty-four gradation potentials VG1-VG64 obtained by dividing the difference between VH and VL (VH−VL) by 65 resistance values R1-R65 of resistors 21.1-21.65 are output to 64 nodes N1*a*-N64*a* located between resistor 21.1 and resistor 21.65, respectively. Resistance values R1-R65 of resistors 21.1-21.65 are set according to optical characteristics of liquid crystal cell 2, such as gamma characteristic.

Ladder resistor circuit 22 includes 65 resistors 23.1-23.65 connected in series between the line of low potential VL and one terminal of switch S0. The other terminal of switch S0 is connected to the line of high potential VH. When switch S0 is turned ON, 64 gradation potentials VG1-VG64 obtained by dividing the difference between VH and VL (VH−VL) by 65 resistance values r1-r65 of resistors 23.1-23.65 are output to 64 nodes N1*b*-N64*b* located between resistor 23.1 and resistor 23.65, respectively.

Resistance values r1-r65 of resistors 23.1-23.65 are set at 1/k (where k>1) of resistance values R1-R65 of resistors 21.1-21.65, respectively, that is, r1=R1/k, r2=R2/k, . . . , r65=R65/k. Therefore, when switch S0 is turned ON, the potentials of nodes N1*b*-N64*b* attain the same as those of nodes N1*a*-N64*a*, respectively. In addition, the total resistance value of ladder resistor circuit 22 becomes 1/k the total resistance value of ladder resistor circuit 20, and a current I2 flowing through ladder resistor circuit 22 when switch S0 is turned ON is k times larger than a current I1 flowing through ladder resistor circuit 20.

Switches S1-S64 are connected between node N1*a* and node N1*b*, node N2*a* and node N2*b*, . . . , and node N64*a* and node N64*b*, respectively. Switches S0-S64 are turned ON/OFF simultaneously. Each of switches S0-S64 may be an N-type transistor, a P-type transistor, or may be formed by connecting an N-type transistor and a P-type transistor in parallel.

When switches S0-S64 are turned OFF, gradation potentials VG1-VG64 are generated only by ladder resistor circuit 20. In this case, a consumption current I of gradation potential generating circuit 16 is suppressed. When switches S0-S64 are turned ON in a pulsed manner, gradation potentials VG1-VG64 are generated by ladder resistor circuits 20 and 22. In this case, current driving capability of gradation potential generating circuit 16 is enhanced.

Figure 5:
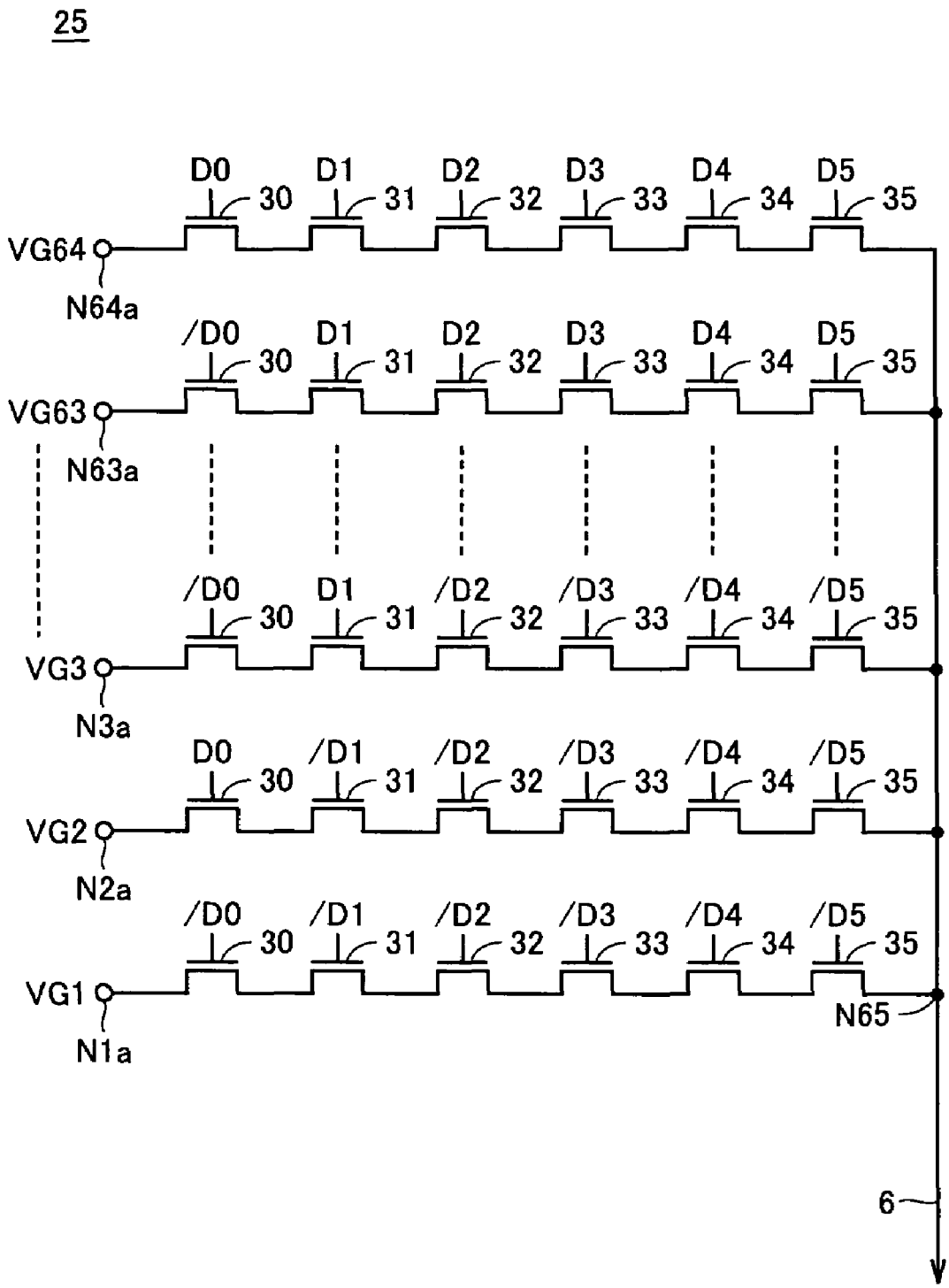
FIG. 5 is a circuit diagram showing a structure of a decode unit circuit included in a decode circuit shown in FIG. 3.

FIG. 5 is a circuit diagram showing a structure of a decode unit circuit 25 included in decode circuit 17. In FIG. 5, decode unit circuit 25 is provided for each data line 6, and includes 64 sets of N-type transistors 30-35 provided corresponding to 64 gradation potentials VG1-VG64, respectively.

N-type transistors 30-35 corresponding to gradation potential VG1 are connected in series between output node N1*a* of gradation potential generating circuit 16 and a node N65, and their gates receive data signals /D0-/D5 from data latch circuit 15, respectively. Node N65 is connected to the corresponding data line 6. When image data signals D5-D0 are "000000", N-type transistors 30-35 become conductive, and gradation potential VG1 is applied to data line 6.

N-type transistors 30-35 corresponding to gradation potential VG2 are connected in series between output node N2*a* of gradation potential generating circuit 16 and node N65, and their gates receive data signals D0 and /D1-/D5 from data latch circuit 15, respectively. When image data signals D5-D0 are "000001", N-type transistors 30-35 become conductive, and gradation potential VG2 is applied to data line 6.

In like manner hereinafter, gradation potentials VG1-VG64 are applied to data line 6 when image data signals D5-D0 are "000000", "000001", . . . , and "111111", respectively.

Figure 6:
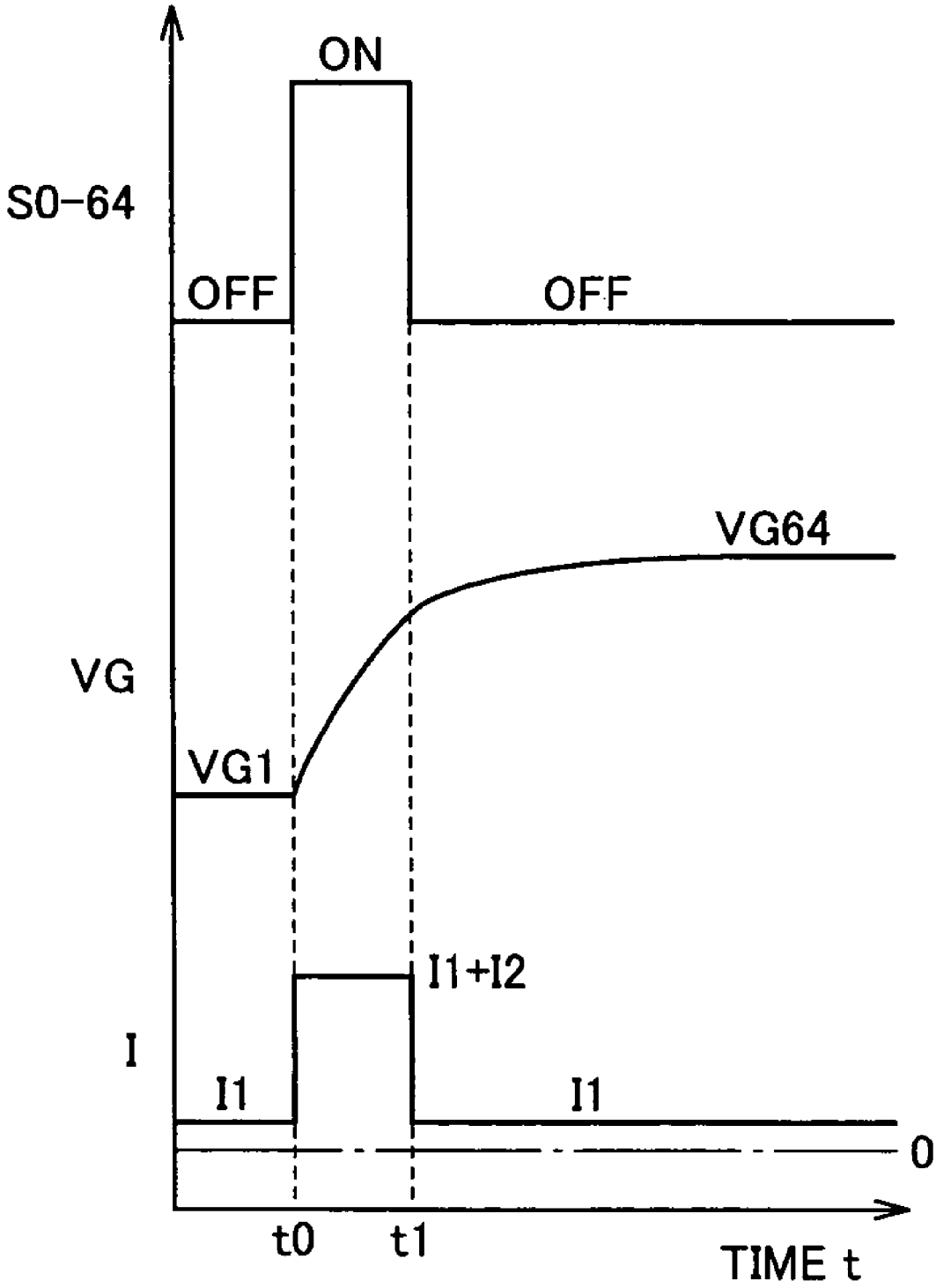
FIG. 6 is a timing chart showing operation of the gradation potential generating circuit and the decode unit circuit shown in FIGS. 4 and 5.

FIG. 6 is a timing chart showing operation of gradation potential generating circuit 16 and decode unit circuit 25 shown in FIGS. 4 and 5. In FIG. 6, at a time before a time t0, switches S0-S64 are turned OFF, and only current I1 of ladder resistor circuit 20 flows across the line of high potential VH and the line of low potential VL. On this occasion, assume that output data signals D5-D0 of data latch circuit 15 are "000000" and gradation potential VG1 is applied to data line 6.

When output data signals D5-D0 of data latch circuit 15 make a transition from "000000" to "111111" at time t0, switches S0-S64 are turned ON to activate ladder resistor circuit 22, and current I1 of ladder resistor circuit 20 plus current I2 of ladder resistor circuit 22 (I1+I2) flows across the line of high potential VH and the line of low potential VL. In addition, node N64*b* is connected to data line 6 via node N64*a*, N-type transistors 30-35, and node N65, and data line 6 is charged by two ladder resistor circuits 20 and 22. Thus, potential VG of data line 6 is quickly increased.

When switches S0-S64 are turned OFF at a time t1 in which potential VG of data line 6 reaches a predetermined value (for example, 90 percent of potential VG64), data line 6 is charged only by ladder resistor circuit 20. Since data line 6 has already been charged at the predetermined value, data line 6 is charged to gradation potential VG64 quickly after time t1. After time t1, only current I1 of ladder resistor circuit 20 flows across the line of high potential VH and the line of low potential VL.

In the present embodiment, ladder resistor circuit 20 having high resistance and ladder resistor circuit having low resistance are provided, and ladder resistor circuit 22 is activated in a pulsed manner when data line 6 is charged/discharged. Therefore, data line 6 can be charged/discharged at a high speed with low current consumption.

Figure 7:
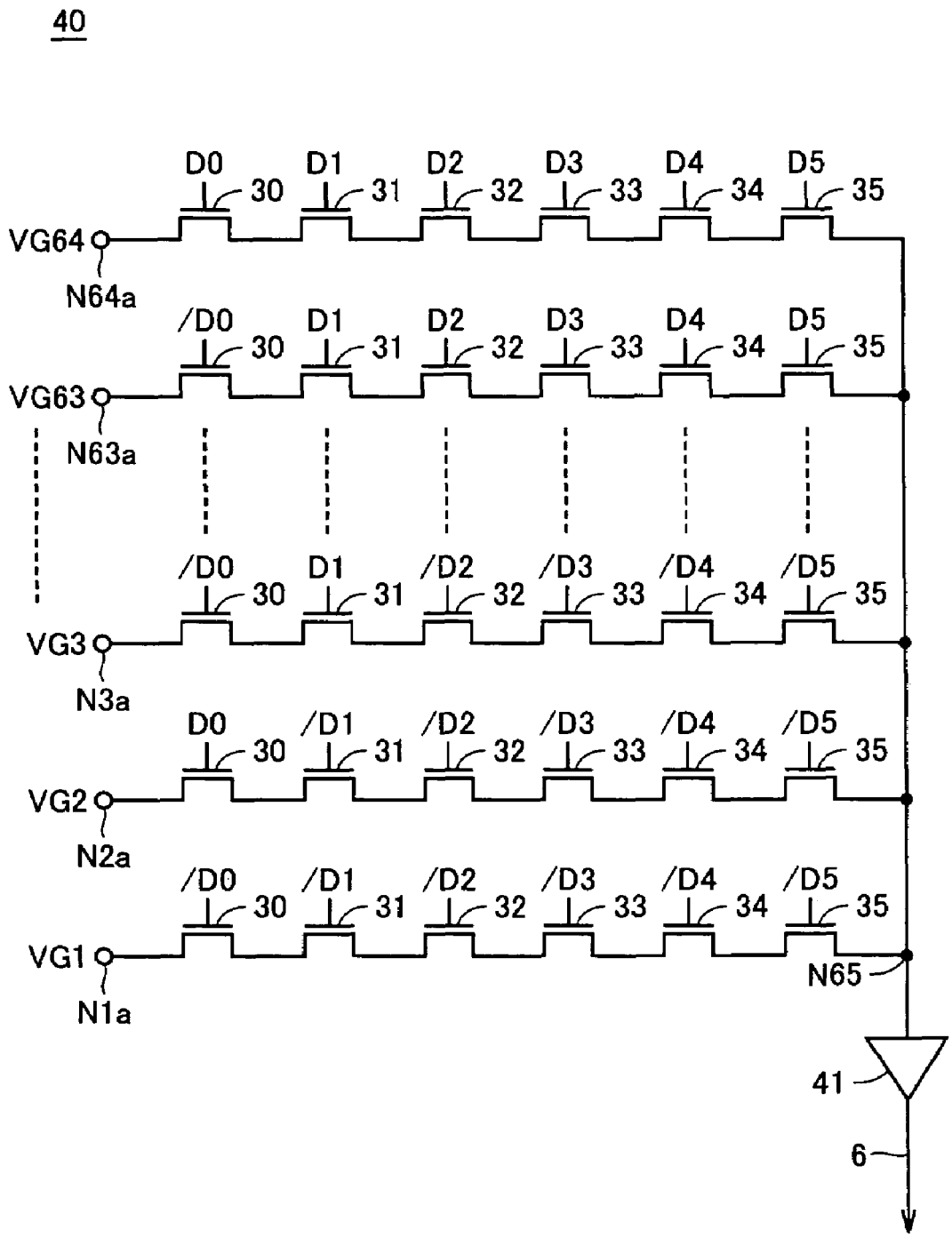
FIG. 7 is a circuit diagram showing a modification of the present embodiment.

FIG. 7 is a circuit diagram showing a modification of the present embodiment. A decode unit circuit 40 in the modification is formed by adding a data line driving circuit 41 to decode unit circuit 25 in FIG. 5. Data line driving circuit 41 is provided between node N65 and data line 6 to subject the potential of node N65 to current amplification and apply it to data line 6. In this case, load capacitance of gradation potential generating circuit 16 can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image display apparatus, comprising:

a pixel array including a plurality of pixel display circuits arranged in a plurality of rows and a plurality of columns and each displaying a pixel in response to a gradation potential, a plurality of gate lines provided corresponding to said plurality of rows, respectively, and a plurality of data lines provided corresponding to said plurality of columns, respectively;

a vertical scanning circuit sequentially selecting said plurality of gate lines for a prescribed time period and activating each pixel display circuit corresponding to the selected gate line;

a gradation potential generating circuit outputting a plurality of gradation potentials different from each other; and a decode circuit provided corresponding to each data line and selecting one of said plurality of gradation potentials in response to an image data signal to apply the selected gradation potential to the activated pixel display circuit via a corresponding data line while one gate line is selected by said vertical scanning circuit;

said gradation potential generating circuit including;

a first ladder resistor circuit having a relatively high resistance value and generating said plurality of gradation potentials by dividing a power supply voltage to apply the generated plurality of gradation potentials to a plurality of first nodes, respectively, a second ladder resistor circuit having a relatively low resistance value, activated during an initial predetermined period of a time period during which the gradation potential selected by said decode circuit is applied to the corresponding data line, and generating said plurality of gradation potentials by dividing said power supply voltage, and a switching circuit applying said plurality of gradation potentials generated by said second ladder resistor circuit for said predetermined period to said plurality of first nodes, respectively;

the first ladder resistor circuit including first resistors connected together in series and the second ladder resistor circuit including second resistors connected together in series; and said switching circuit including a plurality of switches disposed between respective ones of the first and second resistors.

2. The image display apparatus according to claim 1, wherein a specific image data signal is assigned beforehand to each of said plurality of gradation potentials, said decode circuit includes a plurality of transistor groups provided corresponding to said plurality of gradation potentials, respectively, each group including a plurality of transistors, said plurality of transistors in each transistor group are connected in series between a corresponding first node and a second node, and become conductive in response to a corresponding image data signal, and said second node is connected to a corresponding data line.

3. The image display apparatus according to claim 1, wherein said decode circuit includes a driving circuit subjecting the selected gradation potential to current amplification and apply the potential to the corresponding data line.

4. The image display apparatus according to claim 3, wherein said plurality of switches are configured to operate during the initial predetermined period to reduce a resistance of the gradation potential generating circuit.

5. The image display apparatus according to claim 3, wherein said plurality of switches are configured to operate in a pulsed manner.

6. The image display apparatus according to claim 3, wherein:

said first resistors have first node connections disposed therebetween and said second resistors have second node connections disposed therebetween, and said plurality of switches are connected respectively across ones of said first node connections and second node connections.

7. The image display apparatus according to claim 3, wherein:

a number of the first resistors exceeds a number of the switches.

8. The image display apparatus according to claim 3, wherein:

a number of the second resistors exceeds a number of the switches.

9. The image display apparatus according to claim 3, wherein a resistance of the second resistors is set to a fraction of a resistance of the first resistors.

10. The image display apparatus according to claim 3, wherein the switching circuit further comprises an entry switch to the first ladder resistor circuit.

11. The image display apparatus according to claim 10, wherein:

the first ladder resistor circuit includes first resistors connected together in series and the second ladder resistor circuit includes second resistors connected together in series, and said switching circuit includes a plurality of switches disposed between respective ones of the first and second resistors.

12. The image display apparatus according to claim 11, wherein the entry switch and the plurality of switches are configured to operate simultaneously.

13. The image display apparatus according to claim 12, wherein the entry switch and the plurality of switches are configured to operate during the initial predetermined period to reduce a resistance of the gradation potential generating circuit.

14. The image display apparatus according to claim 12, wherein the entry switch and the plurality of switches are configured to operate in a pulsed manner.

* * * * *